US011322123B2

(12) United States Patent
O'Brien

(10) Patent No.: US 11,322,123 B2
(45) Date of Patent: May 3, 2022

(54) EFFECTS AND CONTROLLER PEDAL BOARD

(71) Applicant: Gregory O'Brien, Shade, OH (US)

(72) Inventor: Gregory O'Brien, Shade, OH (US)

( * ) Notice: Subject to any disclaimer, the term of this patent is extended or adjusted under 35 U.S.C. 154(b) by 0 days.

(21) Appl. No.: 16/358,577

(22) Filed: Mar. 19, 2019

(65) Prior Publication Data

US 2019/0287504 A1 Sep. 19, 2019

Related U.S. Application Data

(60) Provisional application No. 62/795,605, filed on Jan. 23, 2019, provisional application No. 62/644,684, filed on Mar. 19, 2018.

(51) Int. Cl.
*G10H 1/34* (2006.01)

(52) U.S. Cl.
CPC ..... *G10H 1/348* (2013.01)

(58) Field of Classification Search
CPC G10H 1/32; G10H 1/34; G10H 1/348; G10H 2210/155; G10H 1/0091; G10H 2220/155; G10H 2230/371; G10H 2240/201; G10H 2220/071; G10H 2220/281; G10D 13/11
See application file for complete search history.

(56) References Cited

U.S. PATENT DOCUMENTS

| | | | | |
|---|---|---|---|---|
| 6,352,240 | B1 * | 3/2002 | Eckstein | A61G 7/018 137/636.1 |
| 6,538,185 | B1 * | 3/2003 | Stratton | G10H 1/32 84/422.1 |
| 6,723,909 | B1 * | 4/2004 | Hooper, II | G10G 5/00 84/177 |
| D781,954 | S * | 3/2017 | Wilfer | D17/20 |
| D782,567 | S * | 3/2017 | Faoro | D17/20 |
| 9,691,369 | B2 * | 6/2017 | Trifilio | G10D 1/085 |
| D815,682 | S * | 4/2018 | Trifilio | D17/20 |
| D819,120 | S * | 5/2018 | Wilfer | D17/20 |
| D819,121 | S * | 5/2018 | Kushner | D17/20 |
| D820,904 | S * | 6/2018 | Fiden | D17/99 |
| 9,997,149 | B2 * | 6/2018 | Trifilio | G10D 1/085 |
| D824,993 | S * | 8/2018 | Trifilio | D17/20 |
| D828,440 | S * | 9/2018 | Trifilio | D17/20 |
| D831,103 | S * | 10/2018 | Trifilio | D17/20 |
| D832,333 | S * | 10/2018 | Kushner | D17/20 |
| D832,334 | S * | 10/2018 | Kushner | D17/20 |
| D838,575 | S * | 1/2019 | Helweg | D8/354 |
| D847,898 | S * | 5/2019 | Kushner | D17/20 |
| 2005/0126372 | A1 * | 6/2005 | Ludwig | G10H 1/32 84/645 |

(Continued)

*Primary Examiner* — Marlon T Fletcher
(74) *Attorney, Agent, or Firm* — York Law LLC; Olen L. York, II

(57) ABSTRACT

A pedal board apparatus includes a single-tier, a double-tier, and a triple-tier variant, wherein each tier includes a deck having a top surface and an opposing bottom surface. Each deck is bound by a first sidewall and a second sidewall. Each sidewall comprises a plurality of ports providing ingress and egress for cables and/or connectors. Each deck has an incline wherein the first sidewall has a greater height than the second sidewall, and each intermediate sidewall has a height greater than the second sidewall. The apparatus may include at least one handle disposed along the deck.

20 Claims, 8 Drawing Sheets

(56) References Cited

U.S. PATENT DOCUMENTS

| | | | | |
|---|---|---|---|---|
| 2005/0126378 | A1* | 6/2005 | Ludwig | G10H 1/32 84/746 |
| 2007/0295190 | A1* | 12/2007 | Collins | G10H 1/32 84/422.1 |
| 2011/0271821 | A1* | 11/2011 | McKinney | G10H 1/348 84/746 |
| 2011/0303077 | A1* | 12/2011 | Vinciguerra | G10H 1/0091 84/746 |
| 2013/0298752 | A1* | 11/2013 | Juszkiewicz | G10H 1/34 84/746 |
| 2013/0327201 | A1* | 12/2013 | Urry | G10H 1/348 84/626 |
| 2016/0171959 | A1* | 6/2016 | Canivell Grifols | G10G 5/00 84/453 |
| 2017/0206879 | A1* | 7/2017 | Fiden | G10H 1/348 |
| 2017/0243572 | A1* | 8/2017 | Trifilio | G10H 1/342 |
| 2018/0151162 | A1* | 5/2018 | McKenzie | G10H 1/348 |
| 2019/0139523 | A1* | 5/2019 | Haberlah | G10H 1/02 |
| 2019/0259359 | A1* | 8/2019 | Ludwig | G10H 1/348 |
| 2019/0287504 | A1* | 9/2019 | O'Brien | G10H 1/348 |
| 2020/0294480 | A1* | 9/2020 | Trifilio | G10H 1/32 |
| 2020/0372880 | A1* | 11/2020 | Stanley | G10G 7/00 |
| 2020/0388260 | A1* | 12/2020 | Chickneas | G10H 1/348 |
| 2021/0295809 | A1* | 9/2021 | Reistrup | G10H 1/348 |

* cited by examiner

EFFECTS AND CONTROLLER PEDAL BOARD

I. RELATED APPLICATIONS

This application claims the benefit of U.S. Provisional Application No. 62/644,684, filed on Mar. 19, 2018, and U.S. Provisional Application No. 62/795,605, filed on Jan. 23, 2019.

II. FIELD OF THE INVENTION

This application discloses claims and embodiments generally related to a pedal board for use during a performance to control various audio and/or visual effects.

III. BACKGROUND OF THE INVENTION

Numerous attempts have been made to improve pedal board assemblies, including pedal board switching stations that allows for multiple placements of foot-activated pedal and/or controller effects devices (often referred to as "stomp boxes" or "pedal switches"). Although many devices purport to improve the user's ability to incorporate and control multiple effect components, several of these devices suffer from deficiencies and/or fail to substantially solve the purported problem(s) that remain.

Accordingly, a need exists for an improved apparatus, system, and/or method that provides an improved pedal board assembly apparatus for foot-activated pedal and/or controller effects switches or devices for live performances, such as on-stage special effects, visual effects, lighting effects, sound effects, and/or combinations and/or sub-combinations thereof.

IV. SUMMARY OF THE INVENTION

In one embodiment, a pedal board apparatus comprises a single-tier deck having an upward incline from the second sidewall to the first sidewall. The pedal board apparatus includes a plurality of ports and apertures for the routing of wiring and cable(s) therethrough.

In another embodiment, a pedal board apparatus comprises a double-tier arrangement, whereby each tier comprises a separate deck, generally denoted as a first deck and second deck, with an intermediate sidewall formed between the first deck and the second deck. The first deck and second deck include a plurality of ports and apertures for routing of wiring and cable(s) therethrough.

In another embodiment, a pedal board apparatus comprises a triple-tier arrangement, whereby each tier comprises a separate deck, generally denoted as a first deck, a second deck, and a third deck, with a first intermediate sidewall between the first deck and the second deck, and a second intermediate sidewall between the second deck and the third deck. The first deck, second deck, and third deck each include a plurality of ports and apertures for routing of wiring and cable(s) therethrough.

Each embodiment may further comprise at least one handle.

Each embodiment may further comprise a protective case.

Each embodiment may further comprise bumpers.

Each embodiment may further comprise a plurality of tabs.

Each embodiment may further comprise at least one wing having a wing deck having a curvilinear distal margin and plurality of feet supporting the wing deck.

Each embodiment may further comprise a microphone block for supporting a microphone stand.

Each embodiment may further comprise a brace disposed on the underside of one of the decks and supporting and securing wiring and cable(s) therethrough.

V. BRIEF DESCRIPTION OF THE DRAWING(S)

The advantages and features of the present invention will become better understood with reference to the following more detailed description and claims taken in conjunction with the accompanying drawings, in which like elements are identified with like symbols, and in which:

Figure 5A:
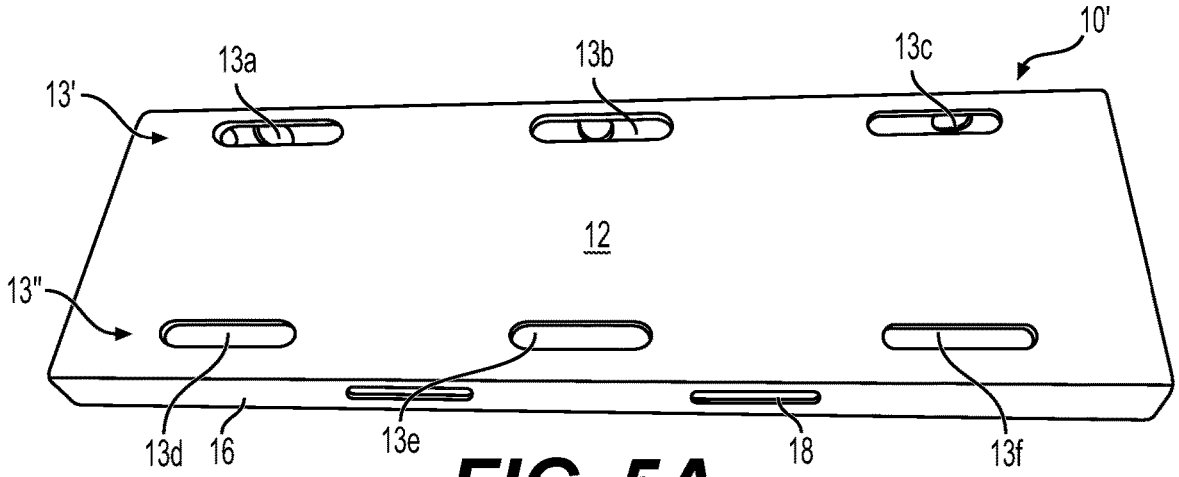
Figure 5B:
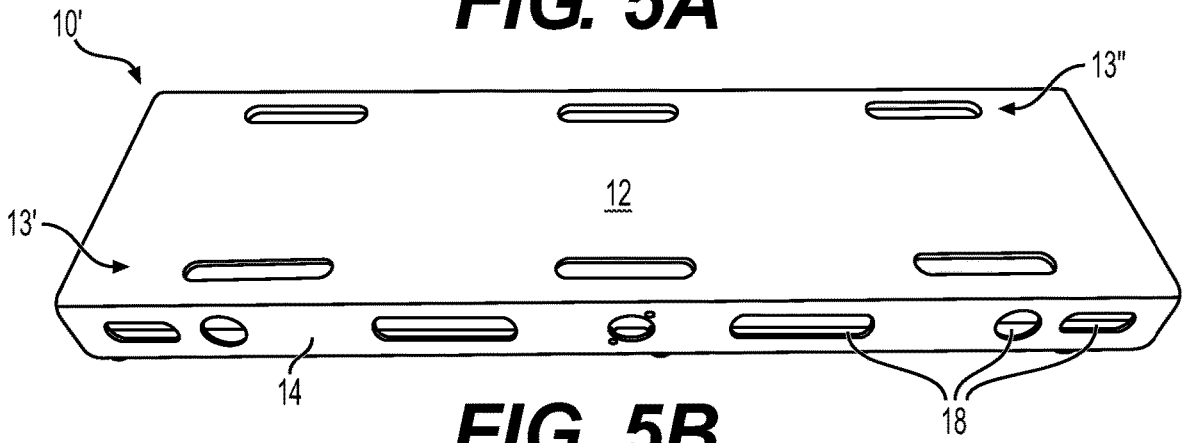
Figure 5C:
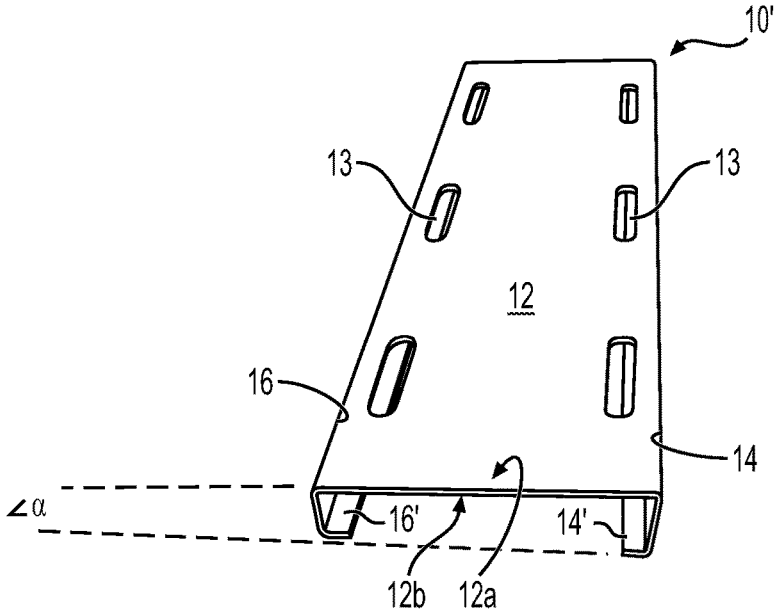
Figure 6A:
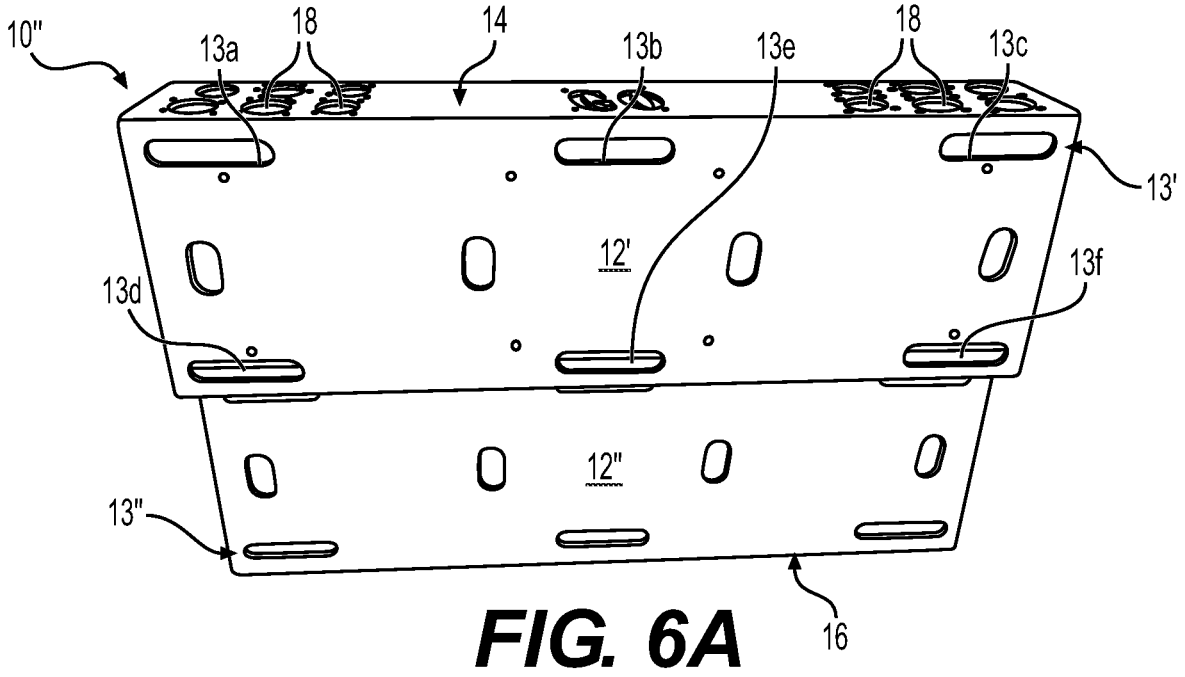
Figure 6B:
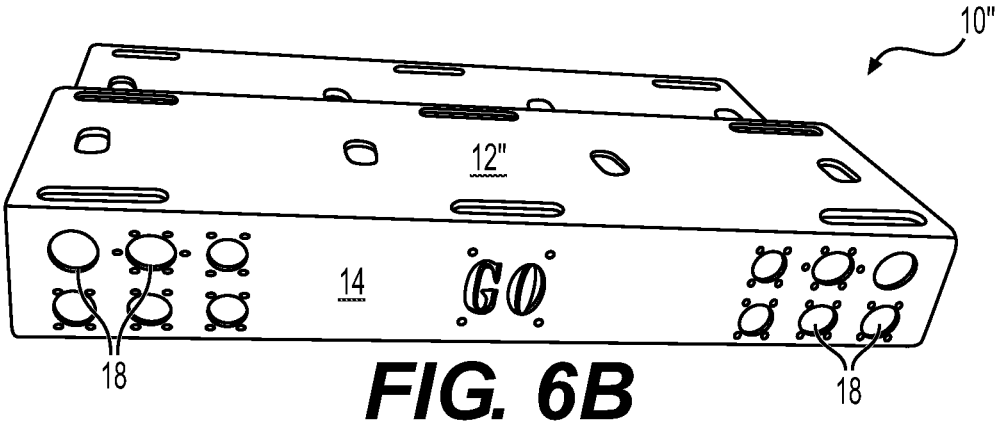
Figure 6C:
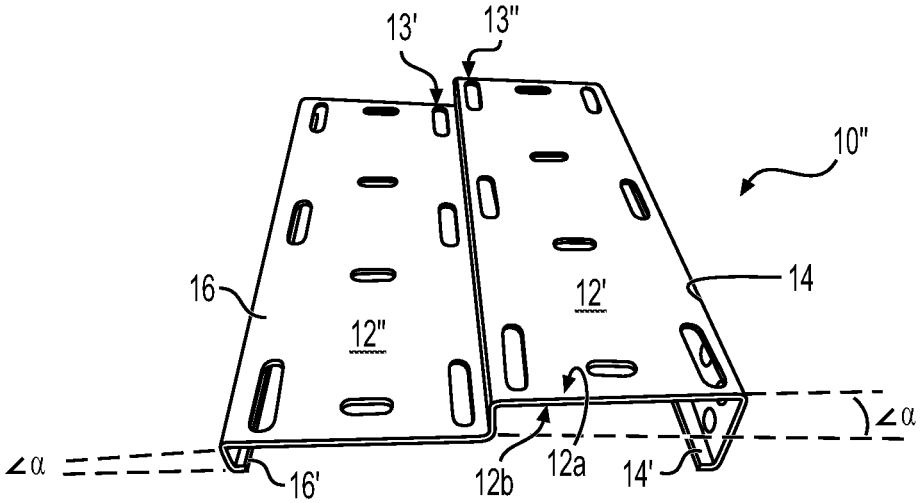
Figure 7A:
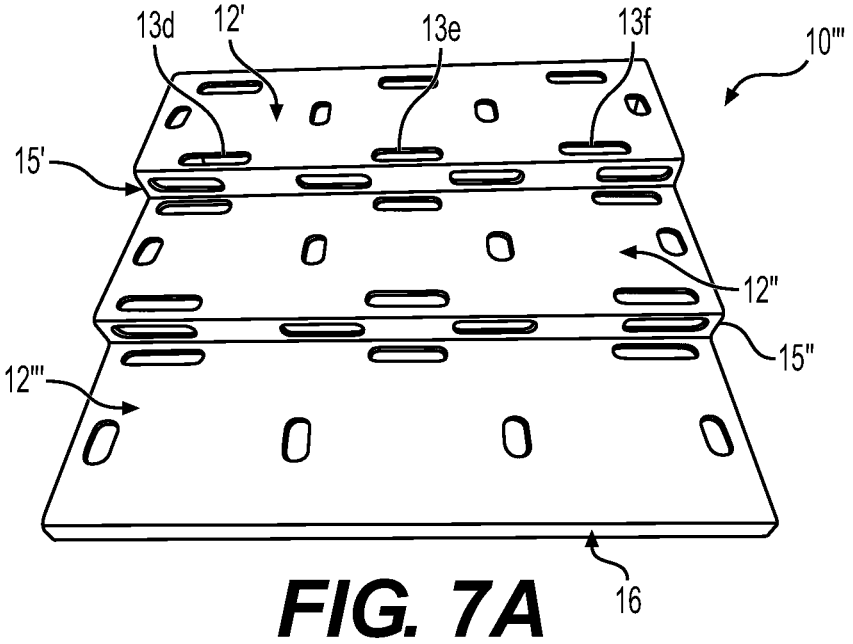
Figure 7B:
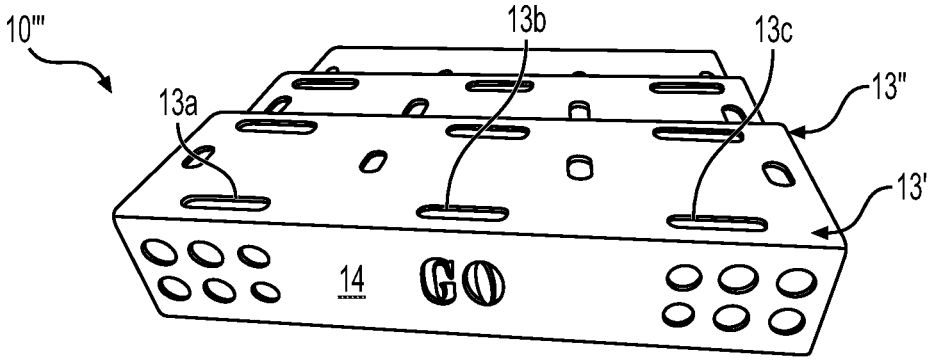
Figure 7C:
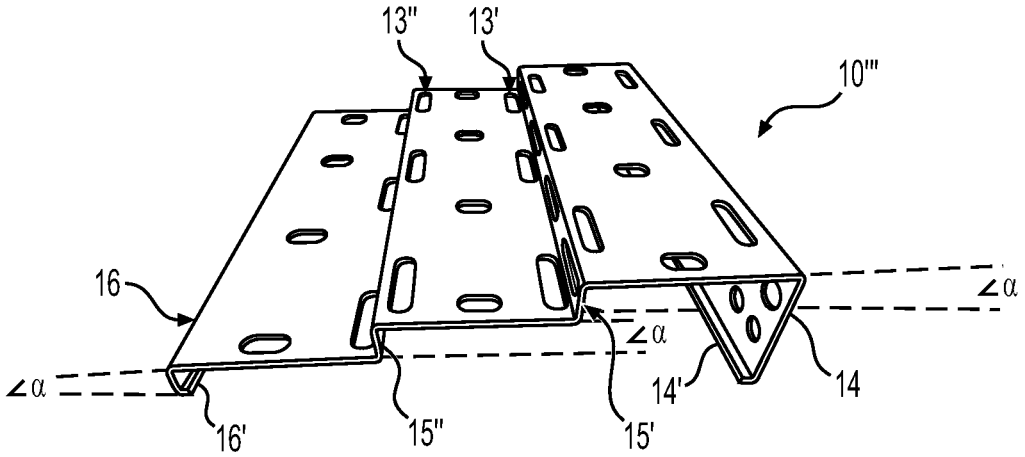
Figure 8A:
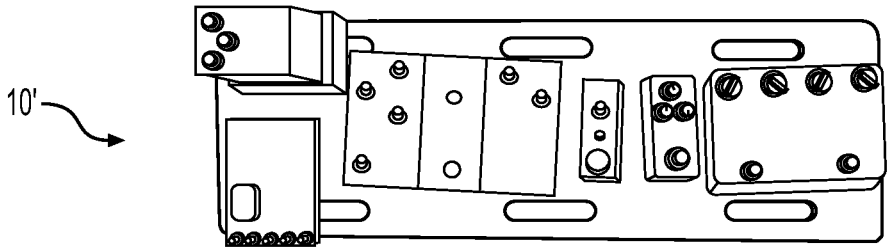
Figure 8B:
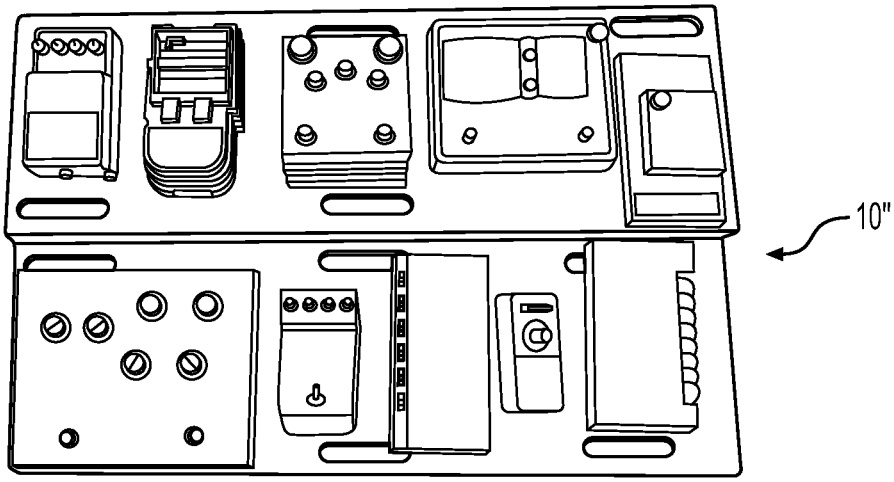
Figure 8C:
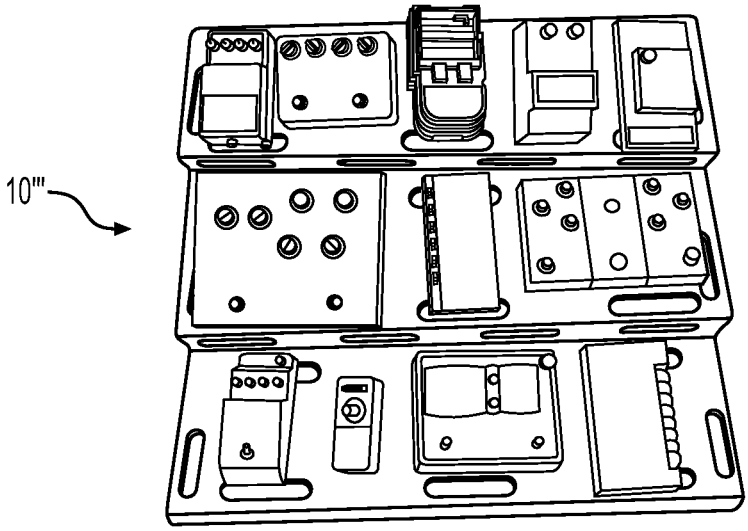
Figure 9:
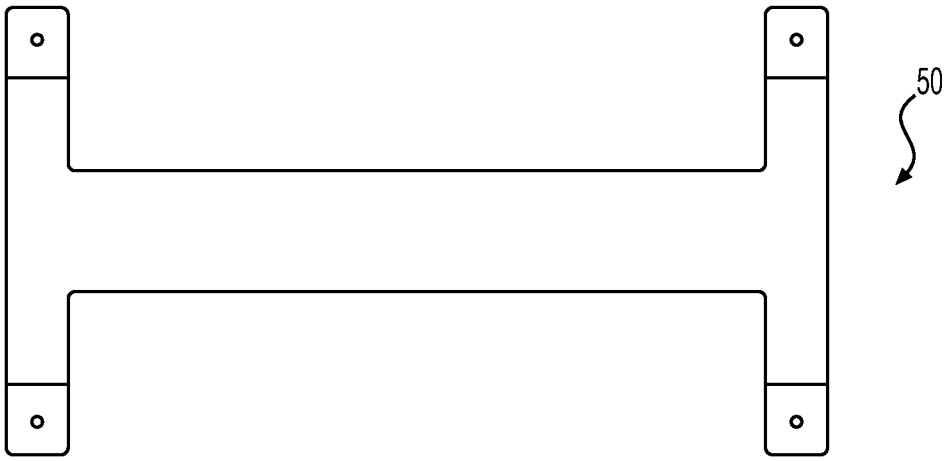
Figure 10:
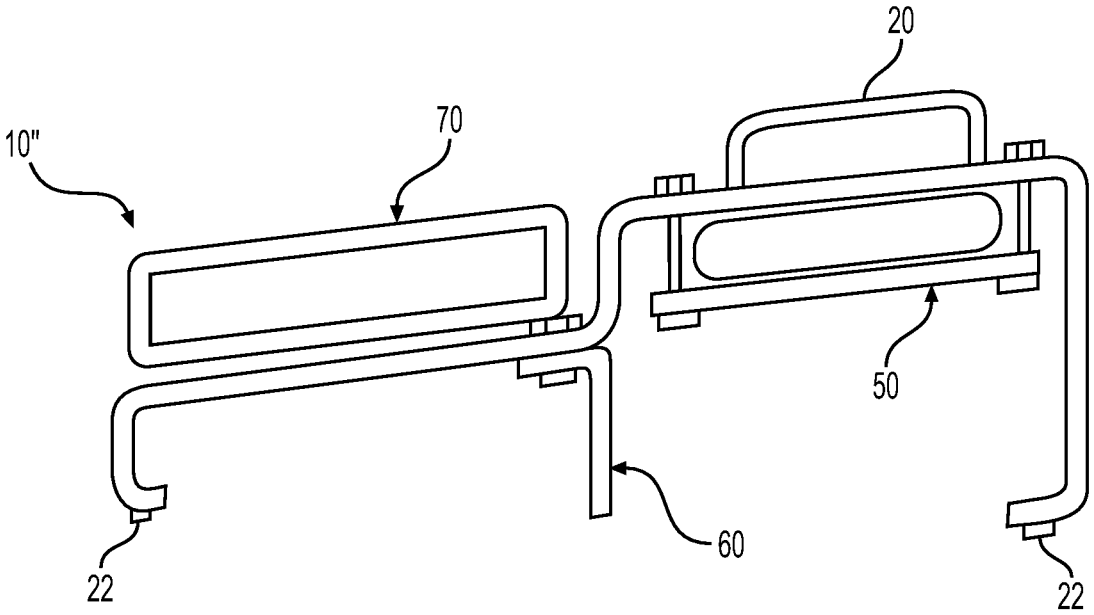
Figure 11A:
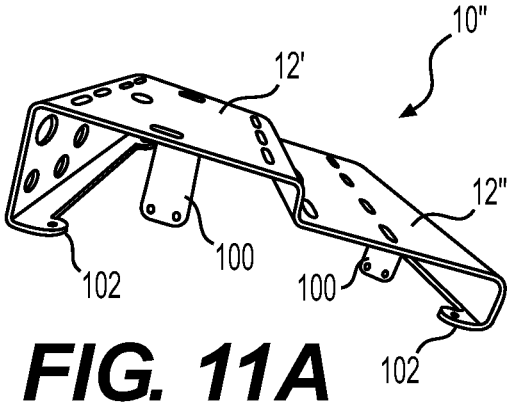
Figure 11B:
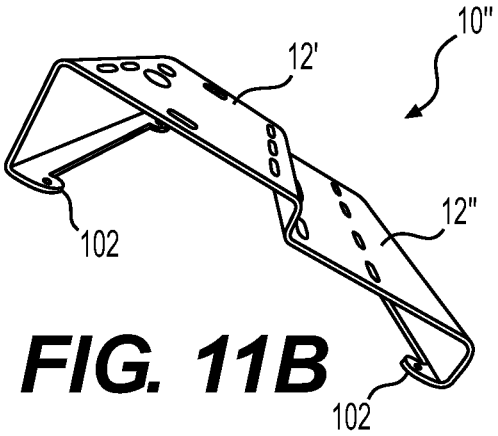
Figure 11C:
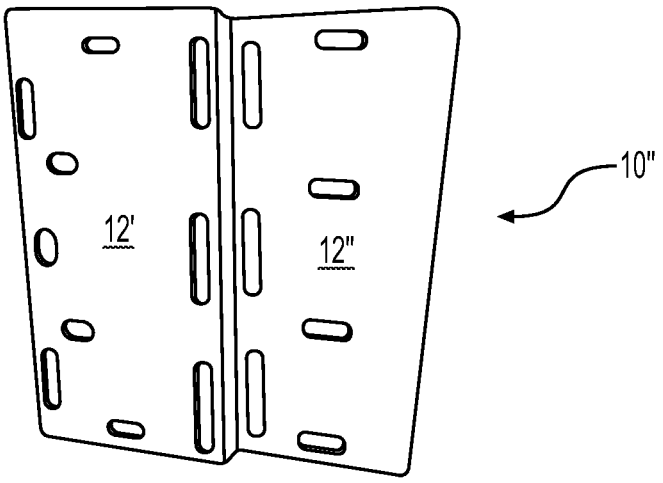
Figure 12A:
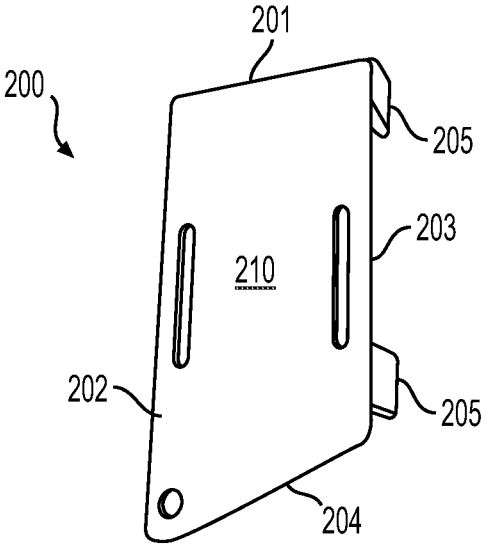
Figure 12B:
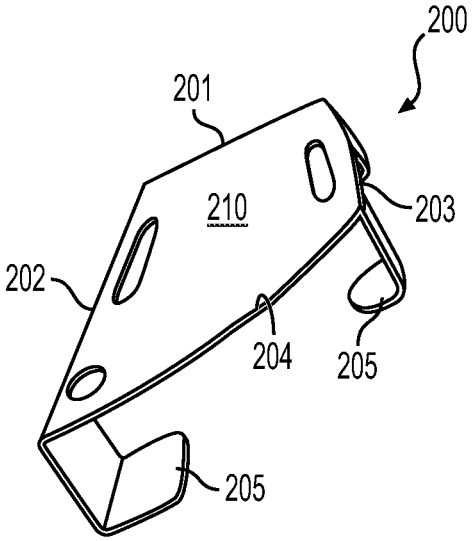

FIG. 5*a* is a front perspective view of a single-tier pedal board;

FIG. 5*b* is a rear perspective view of a single-tier pedal board;

FIG. 5*c* is a side-view of a single-tier pedal board;

FIG. 6*a* is a front perspective view of a double-tier pedal board;

FIG. 6*b* is a rear perspective view of a double-tier pedal board;

FIG. 6*c* is a side-view of a double-tier pedal board;

FIG. 7*a* is a front perspective view of a triple-tier pedal board;

FIG. 7*b* is a rear perspective view of a triple-tier pedal board;

FIG. 7*c* is a side-view of a triple-tier pedal board;

FIG. 8*a* is a top perspective view of a single-tier pedal board;

FIG. 8*b* is a top perspective view of a double-tier pedal board;

FIG. 8*c* is a top perspective view of a triple-tier pedal board;

FIG. 9 is a plan view of an I-bracket utilized as a power-supply mounting element or component of the pedal board apparatus;

FIG. 10 is a side-view of a double-tier pedal board apparatus having an I-bracket installed to maintain placement of a power source, an L-shaped support to provide additional support to the center of the apparatus 10, and a deck-leveler that extends the depth of the first deck 12';

FIG. 11*a* is a perspective view of one alternate embodiment of a two-tier pedal board with having alternatively placed ports and apertures and having braces disposed approximately at the midpoint of each tier and downwardly depending from the lateral margins thereof;

FIG. 11*b* is a perspective view of one alternate embodiment of a two-tier pedal board with having alternatively placed ports and apertures;

FIG. 11*c* is a front perspective view of either FIG. 11*a* and/or FIG. 11*b* depicting alternatively placed apertures;

FIG. 12*a* and FIG. 12*b* are perspective views of a wing apparatus that may be disposed or placed along the lateral margins of any of the single or multi-tier pedal board embodiments disclosed herein, with the wing depicted in FIG. 12*a* and FIG. 12*b* a version of a left-side wing and with the understanding and appreciation that a right-side wing is also available and is a mirror image of that depicted in FIG. 12*a* and FIG. 12*b;*

Figure 13:
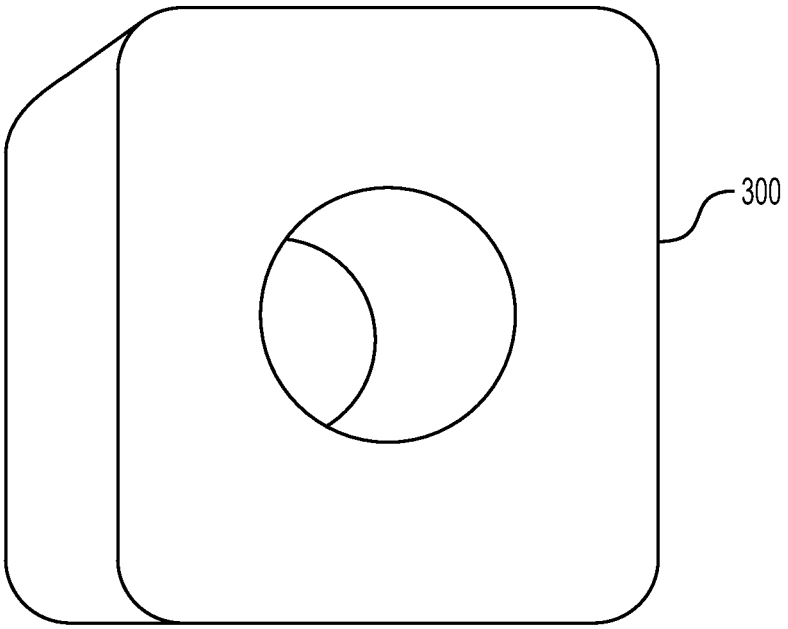
Figure 14:
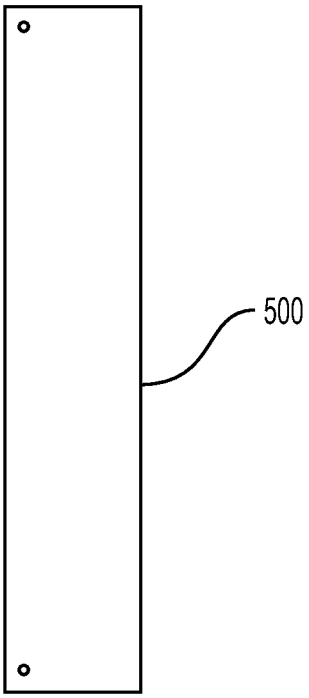

FIG. 13 is a perspective view of a mic-block apparatus that may be placed with and used in conjunction with any of the single or multi-tier pedal board embodiments disclosed herein; and FIG. 14 is a brace for securing wiring and/or cords beneath any of the single or multi-tier pedal board embodiments disclosed herein.

VI. DETAILED DESCRIPTION OF THE EMBODIMENT(S)

It will be readily understood that the components of the present invention, as generally described and illustrated in the figures herein, may be arranged and designed in a wide variety of different configurations. Thus, the following detailed description of the embodiments, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present invention. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

Referring now to the drawings, and in accordance with the drawings illustrating at least one embodiment, consistent with the illustrations of FIG. 1 through FIG. 10, a pedal board apparatus 10 is disclosed and depicted. The apparatus 10 is a mounting device for foot-controlled switching devices and effects pedals utilized during staged performances and/or recordings. Moreover, several embodiments of the apparatus 10 are disclosed, including a single-tier (10') pedal board apparatus, a double-tier (10") pedal board apparatus, and a triple-tier (10'") pedal board apparatus.

It is envisioned that each embodiment of the apparatus (10'/10"/10'") may be configured to accommodate right-handed and left-handed users as necessary. Each disclosed embodiment allows for unobstructed foot articulation through an ergonomically designed pedal and controller deck surface having an inclined surface (described in greater detail below). Each disclosed embodiment allows for personalized layout that is easily reconfigured for multiple quick-changes of effects and/or controller pedals as desired.

Each disclosed embodiment includes a plurality of ports 18 formed in the sidewall 14 or 16, and/or also formed in the deck surface(s) 12'/12"/12'", and it is envisioned that the ports 18 provide a modular patch bay (patch panel) configuration that promotes the use of a single snake cable egressing from the apparatus 10 (10'/10"/10'") during use and allows for separation of front of the amp effects signal and the effects loop signal as desired. Moreover, the ports 18 accommodate solderless connectors and connections.

In accordance with FIGS. 1-3 and 10, it is further envisioned that each disclosed embodiment includes at least one handle 20 disposed in the deck 12 for transporting or quickly moving the apparatus. It is envisioned that the apparatus may include a plurality of handles 20. In accordance with FIG. 10, each disclosed embodiment may include one or more bumpers 22 to provide a skid free apparatus, each bumper 22 formed at the terminal end of each sidewall 14 and 16 consistent with the descriptions of each in greater detail below. It is further envisioned that each disclosed embodiment may comprise a protective shell case for protective storage and/or transportation, wherein the protective shell case accommodates the dimensions and angles of the individual embodiment of apparatus 10 (in association with the single-tier 10', double-tier 10", and/or triple-tier 10'" embodiment of the apparatus 10).

Figure 1:
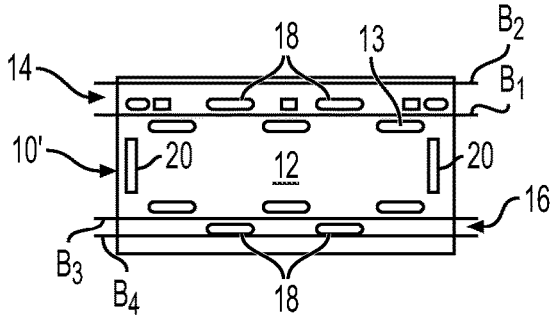
FIG. 1 is a schematic diagrams of a single-tier pedal board formed on a flat, blank sheet of material and with a plurality of ports and apertures formed therein.

In FIG. 1, a single-tier pedal board apparatus 10' comprises a deck 12 having a top surface 12*a* and an opposing bottom surface 12*b*, the deck 12 bound by a first sidewall 14 and a second sidewall 16. Sidewalls 14 and 16 each comprise a plurality of ports 18 providing ingress and egress for cables and/or connectors. Consistent with FIG. 1, sidewall 14 is formed by bending the blank (B) at bend line B1, and with a foot 14' formed by bending at bend line B2. Sidewall 16 is formed by bending the blank (B) at bend line B3, and with a foot 16' formed by bending at bend line B4.

Consistent with FIG. 5*c*, the first sidewall 14 has a greater height than the second sidewall 16, thereby resulting in the deck 12 having a declining pitch from the first sidewall 14 to the second sidewall 16 (or an inclining pitch from the second sidewall 16 to the first sidewall 14). Preferably, the angle of incline $\alpha$ is between 5 degrees and 15 degrees as measured from a horizontal surface. More preferably, the angle of incline $\alpha$ is between 6 degrees and 12 degrees. And more preferably, the angle of incline $\alpha$ is between 7 degrees and 10 degrees. Most preferably, the angle of incline $\alpha$ is approximately 7 degrees.

Consistent with FIGS. 5*a*-5*c*, the deck 12 comprises a plurality of apertures 13. As depicted, the deck 12 may include a first row of apertures 13' adjacent the sidewall 14 and a second row of apertures 13" adjacent the sidewall 16. For each row of apertures 13' and 13", it is envisioned that each individual aperture is equidistant from adjacent apertures within the same row as well as between rows.

In but one example, as exemplified in FIGS. 5*a*-5*c*, the deck 12 comprises a first row of apertures 13' adjacent the sidewall 14 and a second row of apertures 13" adjacent the sidewall 16, wherein each row 13' and 13" comprise three apertures 13*a*-13*c* and 13*d*-13*f* of approximately equal dimension and positioned at equidistant intervals. As depicted, the apertures 13*a*-13*f* have an elongated prolate form. However, other forms or shapes are envisioned as applicable and appropriate.

As most clearly illustrated in FIG. 5*b* and FIG. 5*c*, first sidewall 14 is oriented to form a support depending from the deck 12 whereby the first sidewall 14 downwardly depends from the deck 12 and contacts the floor or stage of a venue. It is envisioned that the first sidewall 14 further comprises a foot 14' depending from the sidewall 14 at approximately a right angle, the foot 14' providing additional support and stability to the apparatus 10 via the sidewall 14. Along the underside of the foot 14' (forming the terminal end of sidewall 14), one or more bumpers 22 may be disposed thereon to provide stability and non-skidding characteristics.

The sidewall 14 further includes a plurality of ports 18. It is envisioned that the ports 18 may comprise a variety of shapes and forms to accommodate different electrical connectors and related components. For example, XLR and/or XLP/power con and IEC-approved electrical connectors for interconnecting or coupling audio equipment (such as a microphone/AC power and audio signal) may be accommodated by the ports 18 by providing circular ports therein. It is also envisioned that the ports 18 may accommodate a USB connector that facilitates interconnection between a power source and an electronic device that requires battery recharging. It is further envisioned that the ports 18 may include any electronic connectors necessary to accommodate the variety of effects, pedals, and/or other controls therein.

As illustrated in FIG. 5*a* and FIG. 5*c*, second sidewall 16 is oriented to form a support depending from the deck 12 whereby the second sidewall 16 downwardly depends from the deck 12 and contacts the floor or stage of a venue. It is envisioned that the second sidewall 16 further comprises a foot 16' depending from the sidewall 16 at approximately a right angle, the foot 16' providing additional support and stability to the apparatus 10 via the sidewall 16. Along the underside of the foot 16' (forming the terminal end of sidewall 16), one or more bumpers 22 may be disposed thereon to provide stability and non-skidding characteristics. The sidewall 16 further includes a plurality of ports 18". It is envisioned that the ports 18 may comprise a variety of shapes and forms to accommodate different electrical connectors and related components. For example, elongated ports are generally included to accommodate cabling, whereas round or circular ports are for electrical connectors. It is envisioned that round ports may be oriented along the deck 12' surface to accommodate patch bay (also known as "patch panel", "patch field", and/or "jack field") options.

A single-tier pedal board apparatus 10' embodiment may comprise a variety of dimensions. It is envisioned that the single-tier pedal board apparatus 10 may have a width between approximately 24-inches and 36-inches. However, the apparatus 10' may be customized to widths smaller or larger than the range provided. It is also envisioned that the single-tier pedal board apparatus 10 may have a depth between 6-inches and 12-inches.

Figure 2:
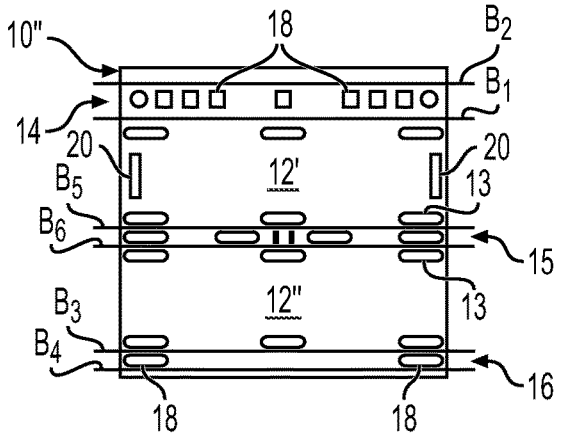
FIG. 2 is a schematic diagrams of a double-tier pedal board formed on a flat, blank sheet of material and with a plurality of ports and apertures formed therein.

In FIG. 2, a double-tier pedal board apparatus 10" comprises a first deck 12' and a second deck 12", wherein each deck 12' and 12" has a top surface 12*a* and an opposing bottom surface 12*b*, the decks 12' and 12" bound by a first sidewall 14 and a second sidewall 16 and having an intermediate sidewall 15 that simultaneously serves as the second sidewall of first deck 12' and the first sidewall of second deck 12". Sidewalls 14, 15, and 16 each comprise a plurality of ports 18 providing ingress and egress for cables and/or connectors. Consistent with FIG. 2, sidewall 14 is formed by bending the blank (B) at bend line B1, and with a foot 14' formed by bending at bend line B2. Sidewall 16 is formed by bending the blank (B) at bend line B3, and with a foot 16' formed by bending at bend line B4. Intermediate sidewall 15 is formed by bending the blank (B) at bend line B5 and bend line B6.

Consistent with FIG. 6*c*, the first sidewall 14 has a greater height than the sidewall 15 and/or sidewall 16, and more particularly the apex of sidewall 14 has a greater height than the apex of sidewall 15 and/or sidewall 16. The greater apex height of sidewall 14 results in the deck 12' having a declining pitch from the first sidewall 14 to the intermediate sidewall 15 (or an inclining pitch from the intermediate sidewall 15 to the first sidewall 14). Sidewall 15 has a greater apex height than sidewall 16 and results in deck 12" having a declining pitch from the intermediate sidewall 15 to second sidewall 16 (or an inclining pitch from the second sidewall 16 to intermediate sidewall 15). Preferably, and specifically for deck 12', the angle of incline $\alpha$ is between 5 degrees and 15 degrees as measured from a horizontal surface. More preferably, the angle of incline $\alpha$ is between 6 degrees and 12 degrees. And more preferably, the angle of incline $\alpha$ is between 7 degrees and 10 degrees. Most preferably, the angle of incline $\alpha$ is approximately 7 degrees. Similarly, and specifically for deck 12", the angle of incline $\alpha$ is between 5 degrees and 15 degrees as measured from a horizontal surface. More preferably, the angle of incline $\alpha$ is between 6 degrees and 12 degrees. And more preferably, the angle of incline $\alpha$ is between 7 degrees and 10 degrees. It is envisioned that one embodiment of the double-tier pedal board apparatus 10' comprises decks 12' and 12" having substantially similar angles of incline $\alpha$. It is also envisioned that another embodiment of the double-tier pedal board apparatus 10' comprises deck 12' having an angle of incline $\alpha$ that is different than the angle of incline $\alpha$ of deck 12".

Consistent with FIGS. 6*a*-6*c*, the decks 12' and 12" each comprise a plurality of apertures 13. As depicted, deck 12' may include a first row of apertures 13' adjacent the sidewall 14 and a second row of apertures 13" adjacent the intermediate sidewall 15. Similarly, deck 12" may include a first row of apertures 13' adjacent the intermediate sidewall 15 and a second row of apertures 13" adjacent the second sidewall 16. For each row of apertures 13' and 13", it is envisioned that each individual aperture is equidistant from adjacent apertures within the same row as well as between rows.

In but one example, as exemplified in FIGS. 6*a*-6*c*, the deck 12' comprises a first row of apertures 13' adjacent the sidewall 14 and a second row of apertures 13" adjacent the sidewall 15, wherein each row 13' and 13" comprise three apertures 13*a*-13*c* and 13*d*-13*f* of approximately equal dimension and positioned at equidistant intervals. Similarly, deck 12" comprises a first row of apertures 13' adjacent the intermediate sidewall 15 and a second row of apertures 13" adjacent the sidewall 16, wherein each row 13' and 13" comprise three apertures 13*a*-13*c* and 13*d*-13*f* of approximately equal dimension and positioned at equidistant intervals. As depicted, the apertures 13*a*-13*f* have an elongated prolate form. However, other forms or shapes are envisioned as applicable and appropriate.

As most clearly illustrated in FIG. 6*b* and FIG. 6*c*, first sidewall 14 is oriented to form a support depending from the deck 12 whereby the first sidewall 14 downwardly depends from the deck 12 and contacts the floor or stage of a venue. It is envisioned that the first sidewall 14 further comprises a foot 14' depending from the sidewall 14 at approximately a right angle, the foot 14' providing additional support and stability to the apparatus 10 via the sidewall 14. The sidewall 14 further includes a plurality of ports 18'. It is envisioned that the ports 18' may comprise a variety of shapes and forms to accommodate different electrical connectors and related components. For example, XLR and/or XLP power con and IEC-approved electrical connectors for interconnecting or coupling audio equipment (such as a microphone) may be accommodated by the ports 18 by providing circular ports therein. It is also envisioned that the ports 18 may accommodate a USB connector that facilitates interconnection between a power source and an electronic device that requires battery recharging. It is further envisioned that the ports 18 may include any electronic connectors necessary to accommodate the variety of effects, pedals, and/or other controls therein. It is further envisioned that a plurality of screw-mounting holes may be included to accommodate differently sized or dimensioned connectors.

As illustrated in FIG. 6*a* and FIG. 6*c*, second sidewall 16 is oriented to form a support depending from the deck 12 whereby the second sidewall 16 downwardly depends from the deck 12 and contacts the floor or stage of a venue. It is envisioned that the second sidewall 16 further comprises a foot 16' depending from the sidewall 16 at approximately a right angle, the foot 16' providing additional support and stability to the apparatus 10 via the sidewall 16. The sidewall 16 further includes a plurality of ports 18". It is envisioned that the ports 18" may comprise a variety of shapes and forms to accommodate different electrical connectors and related components, such as digital multiplex multi-pinout connectors (e.g., DMX), HDMI, XLR, ⅛ inch audio, tip-sleeve (TS), tip-ring sleeve (TRS), speaker twist connector (e.g., such as sold under the trademark "speakON"), a serial bus for high-speed communications and isochronous real-time data transfer (e.g., such as sold under the trademark "FireWire"), and a variety of other similar connectors and cables.

A double-tier pedal board apparatus 10" embodiment may comprise a variety of dimensions. It is envisioned that the single-tier pedal board apparatus 10 may have a width between approximately 24-inches and 36-inches. However, the apparatus 10'" may be customized to widths smaller or larger than the range provided. It is also envisioned that the single-tier pedal board apparatus 10 may have a depth between 6-inches and 12-inches.

Figure 3:
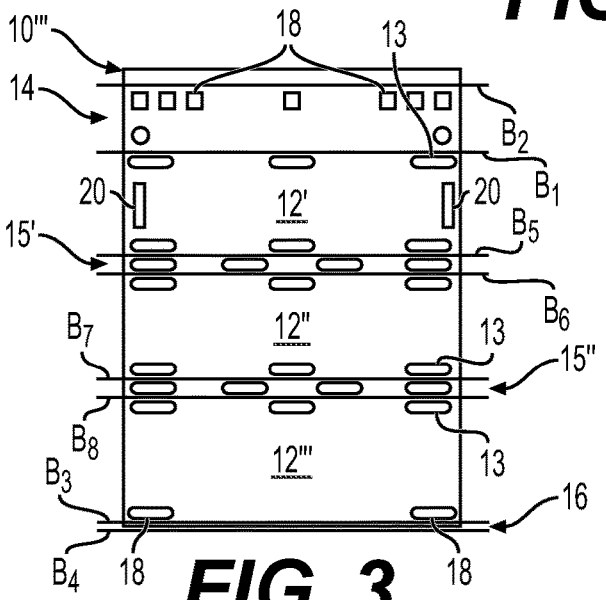
FIG. 3 is a schematic diagrams of a triple-tier pedal board formed on a flat, blank sheet of material and with a plurality of ports and apertures formed therein.

In FIG. 3, a triple-tier pedal board apparatus 10'" comprises a first deck 12' and a second deck 12" and a third deck 12'", wherein each deck 12' through 12'" has a top surface 12*a* and an opposing bottom surface 12*b*, the decks 12' through 12'" bound by a first sidewall 14 and a second sidewall 16 and having a first intermediate sidewall 15' that simultaneously serves as the second sidewall of first deck 12' and the first sidewall of second deck 12" and further having a second intermediate sidewall 15" that simultaneously serves as the second sidewall of second deck 12" and the first sidewall of third deck 12'". Sidewalls 14, 15' and 15", and 16 each comprise a plurality of ports 18 providing ingress and egress for cables and/or connectors. Consistent with FIG. 3, sidewall 14 is formed by bending the blank (B) at bend line B1, and with a foot 14' formed by bending at bend line B2. Sidewall 16 is formed by bending the blank (B) at bend line B3, and with a foot 16' formed by bending at bend line B4. First intermediate sidewall 15' is formed by bending the blank (B) at bend line B5 and bend line B6, and second intermediate sidewall 15" is formed by bending the blank (B) at bend line B7 and bend line B8.

Consistent with FIG. 7*c*, the first sidewall 14 has a greater height than the sidewalls 15' and 15" and/or sidewall 16, and more particularly the apex of sidewall 14 has a greater height than the apex of sidewalls 15' and 15" and/or sidewall 16. The greater apex height of sidewall 14 results in the deck 12' having a declining pitch from the first sidewall 14 to the intermediate sidewall 15' (or an inclining pitch from the intermediate sidewall 15' to the first sidewall 14). Sidewall 15' has a greater apex height than sidewall 15" resulting in deck 12" having a declining pitch from the intermediate sidewall 15' to sidewall 15" (or inclining pitch from sidewall 15" to sidewall 15'). Sidewall 15" has a greater apex height than sidewall 16 and results in deck 12'" having a declining pitch from the intermediate sidewall 15" to second sidewall 16 (or an inclining pitch from the second sidewall 16 to intermediate sidewall 15). Preferably, and specifically for deck 12', the angle of incline α is between 5 degrees and 15 degrees as measured from a horizontal surface. More preferably, the angle of incline α is between 6 degrees and 12 degrees. And more preferably, the angle of incline α is between 7 degrees and 10 degrees. Most preferably, the angle of incline α is approximately 7 degrees. Similarly, and specifically for deck 12", the angle of incline α is between 5 degrees and 15 degrees as measured from a horizontal surface. More preferably, the angle of incline α is between 6 degrees and 12 degrees. And more preferably, the angle of incline α is between 7 degrees and 10 degrees. Similarly, and specifically for deck 12'" the angle of incline α is between 5 degrees and 15 degrees as measured from a horizontal surface. More preferably, the angle of incline α is between 6 degrees and 12 degrees. And more preferably, the angle of incline α is between 7 degrees and 10 degrees. It is envisioned that one embodiment of the triple-tier pedal board apparatus 10' comprises decks 12' and 12" and 12'" having substantially similar angles of incline α. It is also envisioned that another embodiment of the double-tier pedal board apparatus 10' comprises deck 12' having an angle of incline α that is different than the angle of incline α of deck 12" and/or deck 12'".

Consistent with FIGS. 7*a*-7*c*, the decks 12' and 12" and 12'" each comprise a plurality of apertures 13. As depicted, deck 12' may include a first row of apertures 13' adjacent the sidewall 14 and a second row of apertures 13" adjacent the intermediate sidewall 15'. Similarly, deck 12" may include a first row of apertures 13' adjacent the intermediate sidewall 15' and a second row of apertures 13" adjacent the intermediate sidewall 15". Similarly, deck 12'" may include a first row of apertures 13' adjacent the intermediate sidewall 15" and a second row of apertures 13" adjacent the sidewall 16. For each row of apertures 13' and 13", it is envisioned that each individual aperture is equidistant from adjacent apertures within the same row as well as between rows.

In but one example, as exemplified in FIGS. 7*a*-7*c*, the deck 12' comprises a first row of apertures 13' adjacent the sidewall 14 and a second row of apertures 13" adjacent the sidewall 15', wherein each row 13' and 13" comprise three apertures 13*a*-13*c* and 13*d*-13*f* of approximately equal dimension and positioned at equidistant intervals. Similarly, deck 12" comprises a first row of apertures 13' adjacent the intermediate sidewall 15' and a second row of apertures 13" adjacent the sidewall 15", wherein each row 13' and 13" comprise three apertures 13*a*-13*c* and 13*d*-13*f* of approximately equal dimension and positioned at equidistant intervals. Similarly, deck 12'" comprises a first row of apertures 13' adjacent the intermediate sidewall 15" and a second row of apertures 13" adjacent sidewall 16, wherein each row 13' and 13" comprises three apertures 13*a*-13*c* and 13*d*-13*f* of approximately dimension and positioned at equidistant intervals. As depicted, the apertures 13*a*-13*f* have an elongated prolate form. However, other forms or shapes are envisioned as applicable and appropriate.

As most clearly illustrated in FIG. 7*b* and FIG. 7*c*, first sidewall 14 is oriented to form a support depending from the deck 12 whereby the first sidewall 14 downwardly depends from the deck 12 and contacts the floor or stage of a venue. It is envisioned that the first sidewall 14 further comprises a foot 14' depending from the sidewall 14 at approximately a right angle, the foot 14' providing additional support and stability to the apparatus 10 via the sidewall 14. The sidewall 14 further includes a plurality of ports 18'. It is envisioned that the ports 18' may comprise a variety of shapes and forms to accommodate different electrical connectors and related components. For example, XLR and/or XLP electrical connectors for interconnecting or coupling audio equipment (such as a microphone) may be accommodated by the ports 18 by providing circular ports therein. It is also envisioned that the ports 18 may accommodate a USB connector that facilitates interconnection between a power source and an electronic device that requires battery recharging. It is further envisioned that the ports 18 may include any electronic connectors necessary to accommodate the variety of effects, pedals, and/or other controls therein.

As illustrated in FIG. 7*a* and FIG. 7*c*, second sidewall 16 is oriented to form a support depending from the deck 12 whereby the second sidewall 16 downwardly depends from the deck 12 and contacts the floor or stage of a venue. It is envisioned that the second sidewall 16 further comprises a foot 16' depending from the sidewall 16 at approximately a right angle, the foot 16' providing additional support and stability to the apparatus 10 via the sidewall 16. The sidewall 16 further includes a plurality of ports 18. It is envisioned that the ports 18 may comprise a variety of shapes and forms to accommodate different electrical connectors and related components.

A triple-tier pedal board apparatus 10''' embodiment may comprise a variety of dimensions. It is envisioned that the triple-tier pedal board apparatus 10 may have a width between approximately 24-inches and 48-inches. However, the apparatus 10''' may be customized to widths smaller or larger than the range provided. It is also envisioned that the single-tier pedal board apparatus 10 may have a depth between 6-inches and 12-inches.

In all embodiments of the pedal board apparatus, the decks 12' and/or 12" and/or 12''' may include a plurality of holes to allow for attachment of an "I-shaped" bracket 50 that can secure one or more power source components to the underside of the apparatus 10' and/or 10" and/or 10'''. FIG. 9 and FIG. 10 illustrate the bracket 50 separate and installed. In one embodiment of the bracket 50, such as the top view of FIG. 9, it is envisioned that the opposing north-to-south stems with holes for screws may be offset and recessed to butt-against the underside of the apparatus 10 embodiments for secure attachment.

In the double-tier 10" and triple-tier 10''' embodiments, one or more support braces 60 may be included for installation. The support brace 60 may be installed to provide additional support to the adjacent deck 12' and/or 12" and/or 12''' nearest the installation point of the brace 60. It is envisioned that multiple braces 60 may be installed for a single deck 12' or 12" or 12'. It is also envisioned that multiple braces 60 may be installed for multiple decks 12' and/or 12" and/or 12'. It is envisioned that the brace 60 has an L-shape side-view appearance, although other shapes and forms suitable for providing sufficient additional support are envisioned.

Moreover, in the double-tier 10" and triple-tier 10' embodiments, a deck-leveler 70 may be included to extend the depth of deck 12' and/or 12". The deck-leveler 70 may comprise a square or rectangular shape having a height approximately equal to the height differential between adjacent decks and having an incline similar to the decks, wherein the deck-leveler 70 is installed at a lower deck to extend the depth of the adjacent deck. The deck-leveler 70 allows installation of effects devices and/or pedals that may be older, larger, and otherwise difficult to install without the deck-leveler 70.

Figure 4:
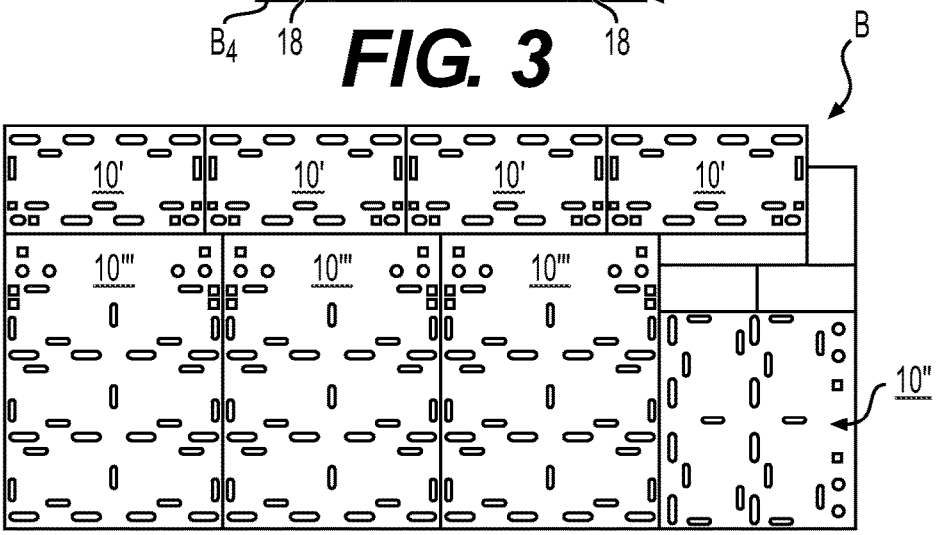
FIG. 4 is a schematic diagram of a single flat, blank sheet template from which a single-tier, a single double-tier, and a single triple-tier pedal board may be formed, including deck-leveling components, as represented in FIG. 1 through FIG. 3.

Although it is envisioned that each type of apparatus 10'/10"/10''' may be formed from a single sheet of material, consistent with FIG. 1, and FIG. 2, and FIG. 3, respectively, and/or FIG. 4, it is also envisioned that each bend line (Bx) may represent a margin at which material may be joined by other means, including mechanical, adhesive, solder, impingement or force-fit coupling, and other similar means. In one embodiment, the apparatus (10'/10"/10''') may be formed of a single-sheet of 3003 series aluminum that is bent-to-shape. Other materials are also envisioned, especially materials capable of such bent-to-shape formation. It is envisioned that the accompanying stabilizing elements (such as the brace 60) providing extra strength and durability to the formed apparatus (10'/10"/10''').

FIGS. 8*a* through 8*c* depict each of three embodiments (single-tier, double-tier, and triple tier) with foot-activated pedal effect switches installed in various configurations. As is evident from the illustrations and images, foot-activated pedal effect switches come in a variety of dimensions, including generally rectangular and approximately square shaped, and therefore, are capable of accommodation of the pedal board embodiments disclosed herewith.

Consistent with FIGS. 11*a*-11*c*, an alternate embodiment of a two-tier pedal board having alternatively placed ports and apertures are depicted. It is envisioned that this arrangement is consistent with alternate embodiments of a single-tier and a triple-tiered pedal boards described herewith and similarly envisioned.

Specifically, FIG. 11*a* depicts an alternate embodiment (two-tiered pedal board 10") having tabs 100 disposed approximately at the midpoint of each deck or tier 12', 12" and downwardly depending from the lateral margins thereof. The tabs 100 provide a point of attachment for optional devices or elements that may be desirable to install and remove as needed. Similar arrangements are envisioned and contemplated for the single-tier (10') and triple-tier (10''') pedal boards, with the tabs 100 disposed approximately midpoint of each deck (12 for single-tier) and each deck (12', 12", and 12''' for a triple-tier).

FIGS. 11*a* and 11*b* and FIGS. 12*a* and 12*b* also depict support feet 102 disposed on the underside of the pedal-board apparatus 10". The feet 102 are disposed at or near the respective corners of the underside of the pedal-board apparatus 10".

In FIG. 12*a* and FIG. 12*b*, a wing apparatus 200 that may be disposed or placed along the lateral margins of any of the single or multi-tier pedal board embodiments disclosed herein. As depicted in FIG. 12*a* and FIG. 12*b*, the wing apparatus 200 is a left-side version, and with the understanding and appreciation that a right-side wing is also available and is a mirror image of that depicted in FIG. 12*a* and FIG. 12*b*. The wing apparatus 200 is angled to complement the pitch or angle of the deck or tier 12'/12"/12''' to which is it coupled or joined along a lateral margin on either side. The lateral margin 201 of the wing apparatus 200 adjacent the deck of the pedal-board apparatus is linear, as are the respective front 202 and rear margins 203. The distal margin 204 is curvilinear and intermediately disposed between front and rear margins 202, 203. The wing apparatus 200 also includes multiple feet 205 to support the wing deck 210 of the wing apparatus 200. As depicted, a plurality of ports and/or apertures are included and may be variable in size and placement.

FIG. 13 is a perspective view of a mic-block apparatus 300 that may be placed with and used in conjunction with any of the single or multi-tier pedal board embodiments disclosed. The mic-block 300 is used to support a mic-stand and maintain a microphone in a relatively secure and stable position within the pedal-board apparatus.

FIG. 14 is a brace 500 for securing wiring and/or cords beneath any of the single or multi-tier pedal board embodiments disclosed herein. The brace 500 may be installed between lateral margins and/or along the underside of a deck, or both, or in other alternative forms.

A method of making or manufacturing each of the embodiments (10', 10", 10'") is contemplated, wherein a single sheet of material may be utilized for cutting and forming each of the embodiments described above.

For examples, in a single-tier (10') embodiment, the blank (B) may be oriented to allow an industrial cutting apparatus or machine to create the ports and apertures 18 therethrough. Thereafter, after each separate single-tier (10') article is released from the blank (B), the separate single-tier (10') may be formed using a device for bending the article along bending lines (B1, B2, B3, and B4). After completion of the bends along B1, B2, B3, and B4, a single-tier (10) pedal board apparatus is formed having a deck 12, a first sidewall 14, a second sidewall 16, and ports/apertures 18, in accordance with one embodiment.

In the double-tier (10") and triple-tier (10'") embodiments, the blank (B) may be oriented to allow an industrial cutting apparatus or machine to create the ports and apertures 18 therethrough. Thereafter, after each separate double-tier (10") and triple-tier (10'") article is released from the blank (B), each (10" and 10'") may be formed using a device for bending the article along bending lines (B1, B2, B3, B4, B5, and B6 for double-tier articles and B1, B2, B3, B4, B5, B6, B7, and B8 for triple-tier articles). After completion of the bends along B1, B2, B3, B4, B5, and B6, a double-tier (10") pedal board apparatus is formed having a first deck 12 and a second deck 12', a first sidewall 14, a second sidewall 16, and an intermediate sidewall 15, and ports/apertures 18, in accordance with one embodiment. After completion of the bends along B1, B2, B3, B4, B5, B6, B7, and B8, a triple-tier (10'") pedal board apparatus is formed having a first deck 12, a second deck 12', and a third deck 12", a first sidewall 14, a second sidewall 16, and a first intermediate sidewall 15' and a second intermediate sidewall 15", and ports/apertures 18, in accordance with one embodiment.

It is further envisioned, consistent with FIG. 4, that a single blank (B) may be used for form four single-tier (10') articles, one double-tier (10") article, and three triple-tier (10'") articles. Each of the articles would be cut and formed consistent with the method of manufacture for each of the individual tiers and embodiments described above.

It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

What is claimed is:

1. A pedal board support apparatus for mounting and supporting one or more foot-controlled effects pedals thereon, the support apparatus comprising:

a deck having a top surface and an opposing bottom surface, a plurality of apertures formed through the deck top surface and the deck bottom surface, the deck bound by a first sidewall and a second sidewall, the first sidewall and the second sidewall disposed in mutually opposed orientation to one another, wherein each sidewall comprises a plurality of ports providing ingress and egress for cables and/or connectors of the one or more foot-controlled switching devices and effects pedals mounted thereto;

the first sidewall having a greater height than the second sidewall and defining an incline formed by the deck top surface and the deck bottom surface and traversing from the second sidewall toward the first sidewall; and a bracket for securing one or more power source components to the underside of the deck, wherein the bracket is coupled to the underside of the deck using the plurality of apertures formed through the deck top surface and the deck bottom surface.

2. The apparatus of claim 1 further comprising at least one handle depending from the deck.

3. The apparatus of claim 1, wherein each opposing corner of the first sidewall and each opposing corner of the second sidewall comprise at least one bumper disposed thereon.

4. The apparatus of claim 1 further comprising a protective case.

5. The apparatus of claim 1 further comprising tabs disposed along the opposing lateral margins of the deck.

6. The apparatus of claim 1 further comprising a wing having a wing deck comprising a curvilinear distal margin and a plurality of feet supporting the wing.

7. The apparatus of claim 1 further comprising a microphone block supporting a microphone stand.

8. A pedal board support apparatus for mounting and supporting one or more foot-controlled effects pedals thereon, the support apparatus comprising:

a first deck having a top surface and an opposing bottom surface, a plurality of apertures formed through the first deck top surface and the first deck bottom surface, the first deck bound by a first sidewall and an intermediate sidewall, the first sidewall and the intermediate sidewall disposed in mutually opposed orientation to one another, wherein each sidewall comprises a plurality of ports providing ingress and egress for cables and/or connectors of the one or more foot-controlled switching devices and effects pedals mounted thereto, the first sidewall having a height greater than the intermediate sidewall and defining an incline formed by the first deck top surface and the first deck bottom surface and traversing from the intermediate sidewall to the first sidewall;

a second deck having a top surface and an opposing bottom surface, a plurality of apertures formed through the second deck top surface and the second deck bottom surface, the second deck bound by the intermediate sidewall and a second sidewall, the intermediate sidewall and the second sidewall disposed in mutually opposed orientation to one another, wherein each sidewall comprises a plurality of ports providing ingress and egress for cables and/or connectors of the one or more foot-controlled switching devices and effects pedals mounted thereto, the intermediate sidewall having a height greater than the second sidewall and defining an incline formed by the second deck top surface and the second deck bottom surface and traversing from the second sidewall to the intermediate sidewall; and a bracket for securing one or more power source components to the underside of the first deck or to the underside of the second deck, wherein the bracket is coupled to the underside of the first deck using the plurality of apertures formed through the first deck top surface and the first deck bottom surface, and wherein the bracket is coupled to the second deck using the plurality of apertures formed through the second deck top surface and the second deck bottom surface.

9. The apparatus of claim 8 further comprising at least one handle depending from one of the first deck or the second deck.

10. The apparatus of claim 8 wherein each opposing corner of the first sidewall, each opposing corner of the second sidewall comprise, and each opposing corner of the intermediate sidewall comprise at least one bumper disposed thereon.

11. The apparatus of claim 8 further comprising a protective case.

12. The apparatus of claim 8 further comprising tabs disposed along the opposing lateral margins of the first deck and the second deck.

13. The apparatus of claim 8 further comprising a wing having a wing deck comprising a curvilinear distal margin and a plurality of feet supporting the wing.

14. The apparatus of claim 8 further comprising a microphone block supporting a microphone stand.

15. The apparatus of claim 8 further comprising one or more braces disposed on the underside of the deck at the mutual junction of the intermediate sidewall disposed between the first deck and the second deck.

16. The apparatus of claim 8, wherein the incline from the intermediate sidewall to the first sidewall is greater than the incline from the second sidewall to the intermediate sidewall.

17. A pedal board support apparatus for mounting and supporting one or more foot-controlled effects pedals thereon, the support apparatus comprising:

a first deck having a top surface and an opposing bottom surface, a plurality of apertures formed through the first deck top surface and the first deck bottom surface, the first deck bound by a first sidewall and a first intermediate sidewall, the first sidewall and the first intermediate sidewall disposed in mutually opposed orientation to one another, wherein each sidewall comprises a plurality of ports providing ingress and egress for cables and/or connectors of the one or more foot-controlled switching devices and effects pedals mounted thereto, the first sidewall having a height greater than the intermediate sidewall and defining an incline formed by the first deck top surface and the first deck bottom surface and traversing from the first intermediate sidewall to the first sidewall;

a second deck having a top surface and an opposing bottom surface, a plurality of apertures formed through the second deck top surface and the second deck bottom surface, the second deck bound by the first intermediate sidewall and a second intermediate sidewall, the first intermediate sidewall and the second intermediate sidewall disposed in mutually opposed orientation to one another, wherein each sidewall comprises a plurality of ports providing ingress and egress for cables and/or connectors of the one or more foot-controlled switching devices and effects pedals mounted thereto, the first intermediate sidewall having a height greater than the second intermediate sidewall and defining an incline formed by the second deck top surface and the second deck bottom surface and traversing from the second intermediate sidewall to the first intermediate sidewall;

a third deck having a top surface and an opposing bottom surface, a plurality of apertures formed through the third deck top surface and the third deck bottom surface, the third deck bound by the second intermediate sidewall and a second sidewall, the second intermediate sidewall and the second sidewall disposed in mutually opposed orientation to one another, wherein each sidewall comprises a plurality of ports providing ingress and egress for cables and/or connectors of the one or more foot-controlled switching devices and effects pedals mounted thereto, the second intermediate sidewall having a height greater than the second sidewall and defining an incline formed by the third deck top surface and the third deck bottom surface and traversing from the second sidewall to the second intermediate sidewall, a bracket for securing one or more power source components to the underside of the first deck or to the underside of the second deck or to the underside of the third deck, wherein the bracket is coupled to the underside of the first deck using the plurality of apertures formed through the first deck top surface and the first deck bottom surface, and wherein the bracket is coupled to the second deck using the plurality of apertures formed through the second deck top surface and the second deck bottom surface, and wherein the bracket is coupled to the third deck using the plurality of apertures formed through the third deck top surface and the third deck bottom surface.

18. The apparatus of claim 17 further comprising at least one handle depending from one of the first deck, the second deck, or the third deck.

19. The apparatus of claim 17 further comprising a wing having a wing deck comprising a curvilinear distal margin and a plurality of feet supporting the wing.

20. The apparatus of claim 17 further comprising one or more braces disposed on the underside of the deck at the mutual junction of the first intermediate sidewall disposed between the first deck and the second deck or the mutual junction of the second intermediate sidewall disposed between the second deck and the third deck.

* * * * *